US012807359B2

(12) United States Patent
Adeigbe

(10) Patent No.: US 12,807,359 B2
(45) Date of Patent: Nov. 24, 2026

(54) BOX CLAMPING APPARATUS AND METHOD THEREOF

(71) Applicant: Omowunmi Adeigbe, Yeadon, PA (US)

(72) Inventor: Omowunmi Adeigbe, Yeadon, PA (US)

( * ) Notice: Subject to any disclaimer, the term of this patent is extended or adjusted under 35 U.S.C. 154(b) by 0 days.

(21) Appl. No.: 19/304,312

(22) Filed: Aug. 19, 2025

(65) Prior Publication Data

US 2026/0048886 A1 Feb. 19, 2026

Related U.S. Application Data

(60) Provisional application No. 63/684,757, filed on Aug. 19, 2024.

(51) Int. Cl.

| | |
|---|---|
| ***B65B 51/06*** | (2006.01) |
| ***B65B 7/20*** | (2006.01) |
| ***B65B 67/02*** | (2006.01) |

(52) U.S. Cl.

CPC ..... *B65B 51/067* (2013.01); *B65B 7/20* (2013.01); *B65B 67/02* (2013.01)

(58) Field of Classification Search

CPC ..... B23B 47/287; B23B 2260/088; B23B 2247/10; B23B 2247/12; B23B 2260/004; B23B 2260/0485; B25B 5/102; B25B 5/006; B25B 5/068; B25B 5/003; B25B 5/101; B25B 5/163; B65B 43/12; B65B 43/39; B65B 43/465; B65B 11/585; B65B 35/16; B65B 43/265; B65B 43/28; B65B 43/54; B65B 43/58; B65B 5/105; B65B 67/1233; B65B 67/1211

See application file for complete search history.

(56) References Cited

U.S. PATENT DOCUMENTS

| | | | | |
|---|---|---|---|---|
| 3,695,151 | A * | 10/1972 | Caron | B31B 50/00 493/183 |
| 4,989,847 | A * | 2/1991 | Chapman | B25B 5/068 269/170 |
| 7,641,425 | B2 | 1/2010 | Sommerfeld et al. | |
| 9,121,423 | B2 | 9/2015 | Sharpe et al. | |
| 9,933,001 | B2 | 4/2018 | Gardiner | |
| 10,125,897 | B2 | 11/2018 | Schmidt | |
| 10,365,017 | B2 | 7/2019 | McPheeters | |
| 10,398,495 | B2 | 9/2019 | Morejohn et al. | |
| 10,738,808 | B2 | 8/2020 | Pryor et al. | |
| 11,230,029 | B2 | 1/2022 | Wang | |
| 11,749,915 | B2 | 9/2023 | Quaedvlieg et al. | |
| 2018/0361612 | A1* | 12/2018 | Wang | B25B 5/163 |
| 2022/0315356 | A1* | 10/2022 | Solà Gil | B65B 59/003 |
| 2024/0002099 | A1 | 1/2024 | Drouet | |

* cited by examiner

*Primary Examiner* — Veronica Martin

(74) *Attorney, Agent, or Firm* — Gutwein Law; Tyler B. Droste

(57) ABSTRACT

An adjustable clamping tool for holding a shipping box in a closed position to facilitate a user to apply tape onto the shipping box. The apparatus comprises adjustable arm members configured to align along the box's sidewalls and to position the box's outer flaps together and in a closed position so that the user can easily and properly apply tape onto the box. The apparatus can be adjustable in width between the first arm and second arm along a middle portion to accommodate various box sizes.

2 Claims, 14 Drawing Sheets

BOX CLAMPING APPARATUS AND METHOD THEREOF

CROSS REFERENCE TO RELATED PATENT APPLICATIONS

This U.S. patent application is U.S. Nonprovisional application Number, which claims priority to U.S. Provisional Application No. 63/684,757 filed Aug. 19, 2024, to the above-named inventors, the disclosure of which is considered part of the disclosure of this application and is hereby incorporated by reference in its entirety.

FIELD OF THE INVENTION

The invention relates generally to a clamping apparatus for holding a shipping box and facilitating a user to apply an adhesive tape onto the shipping box for closing the shipping box.

BACKGROUND

Currently there are a number of solutions for helping a user while closing a shipping box with an adhesive tape. One of these solutions attempts to utilize the help from a third party, but this solution fails to meet the needs of the market because a user not always will have help of a third party available. Another solution attempts to use the user's thighs to hold the box, but this solution is similarly unable to meet the needs of the market because a box may be too large for this method to work.

It would be advantageous to have an improved apparatus that can clamp a box in a closed position to facilitate a user to apply an adhesive tape onto the box. Furthermore, it would also be advantageous to have an adjustable apparatus that allows the user to use the same apparatus for various box sizes. Still further, it would be advantageous to have an apparatus that is foldable/collapsible and can be easily stored away. The apparatus of the present disclosure can fulfill an unmet need by providing an adjustable clamping apparatus for holding a shipping box.

BRIEF SUMMARY OF THE INVENTION

In one aspect, an adjustable clamping apparatus of the present disclosure can include adjustable members configured to align along the box's sidewalls and to position the box's outer flaps together in a closed position so that the user can easily and properly apply an adhesive tape onto the box.

In another aspect, the present disclosure provides for an adjustable clamping apparatus for holding a box to facilitate closing the box. The apparatus can include at least two arms, wherein each of the at least two arms comprises a first sidewall and a second sidewall. Each of the at least two arms can have a first end and a second end, wherein the first end and second end define the length of each of the at least two arms, wherein the at least two arms can have an extendable length. The apparatus further comprising a middle portion, removably coupled between the at least two arms, wherein the at least two arms are positioned substantially parallel to each other and each substantially perpendicular to the middle portion. The middle portion comprises a first end and a second end, wherein the first end and second end define the length of the middle portion, wherein the middle portion can have an extendable length. The middle portion and the arms configured to move in gradual portions on a vertical axis to extend the length of the middle portion and the arms. The apparatus may include at least three sliding assemblies configured to move from an open position, wherein the user may be able to extend the length of the arms and/or middle portion, to a locking position, wherein the user may be able lock the apparatus onto the box when the desired length of the arms and/or middle portion is reached. The middle portion and the arms may comprise an internal channel/cavity, configured to receive and securely hold an edge of the box. The sliding assembly can include a first track portion coupled to the sidewall of the middle portion or the arms. A second track portion is at least partially housed within the first track portion and the third track portion is at least partially housed within the second track portion.

In another aspect, the present disclosure relates to an adjustable clamping apparatus having a middle member, a first coupling member, a second coupling member, a first arm member, and a second arm member.

The middle member can have a first end and a second end defining the length of a middle member. A first coupling member can be removably couplable to the middle member. The first coupling member can have an opening portion for partially housing at least a portion of the middle member. The first arm member can be partially housed within the first coupling member. A second coupling member can have an opening portion for partially housing at least a portion of the middle member. The second arm member can be partially housed within the second coupling member. The first and second arms can each have a first and second end defining the length of the arms. The adjustable clamping apparatus 1, wherein the first arm member is movable along an axis within the first coupling member and the second arm member is movable along an axis within the second coupling member. The first coupling member can have a channel configured to house a portion of the first arm member and the second coupling member can have a second channel configured to house a portion of the second arm member. At least one of the first coupling member or second coupling member is slidable along the middle member. At least one coupling member further includes a locking mechanism to maintain the position of the respective coupling member on the middle member. The locking mechanism can include a lever and engagement portion, wherein the engagement member exerts a compressive force against the middle member to prevent the movement of the coupling member. The first coupling member includes the locking mechanism, wherein the engagement member is in contact with a surface of the middle portion to inhibit movement when engaged. The locking mechanism can be disengaged by pulling the lever. At least one of the first arm member or second arm member can be slidably coupled to the middle member. The first arm member and second arm member can have a sidewall surface and a top surface formed perpendicular to each other to form an interfacing portion to engage a box surface. The interfacing portion of the first arm member is configured to align along a first sidewall of the box and the interfacing portion of the second arm member is configured to align along a second sidewall of the box to position a first outer flap and second outer flap of the box together and in a closed position.

In another aspect, the present disclosure relates to an adjustable clamping apparatus having a first arm member having a first end and a second end, a second arm member having a first end and a second end, a middle member having a first end, second end, an interior cavity, a first interior arm, and a second interior arm, wherein a first interior arm has a first and second end and second interior arm having a first and second end, wherein each interior arm is at least partially housed within the interior cavity of the middle member, wherein the first arm member is coupled to the second end of the first interior arm and the second arm member is coupled to the second end of the second interior arm of the middle member. The first arm member can further include a first extension arm slidably coupled to the first arm member. The second arm member can further include a second extension arm slidably coupled to the second arm member. The middle portion can further include an adjustment mechanism configured to move the first interior arm and second interior arm between a first position and a second position. The adjustment mechanism can include a gear ring having a plurality of splines, wherein an interior of the first interior arm includes a plurality of splines and an interior of the second interior arm includes a plurality of splines, wherein the splines of the gear ring interface with the splines of each of the first interior arm and second interior arm.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

FIG. 1C is a cross-section view of a middle portion of an exemplary embodiment of a box clamping apparatus of present disclosure.

DETAILED DESCRIPTION OF THE INVENTION

Figure 1A:
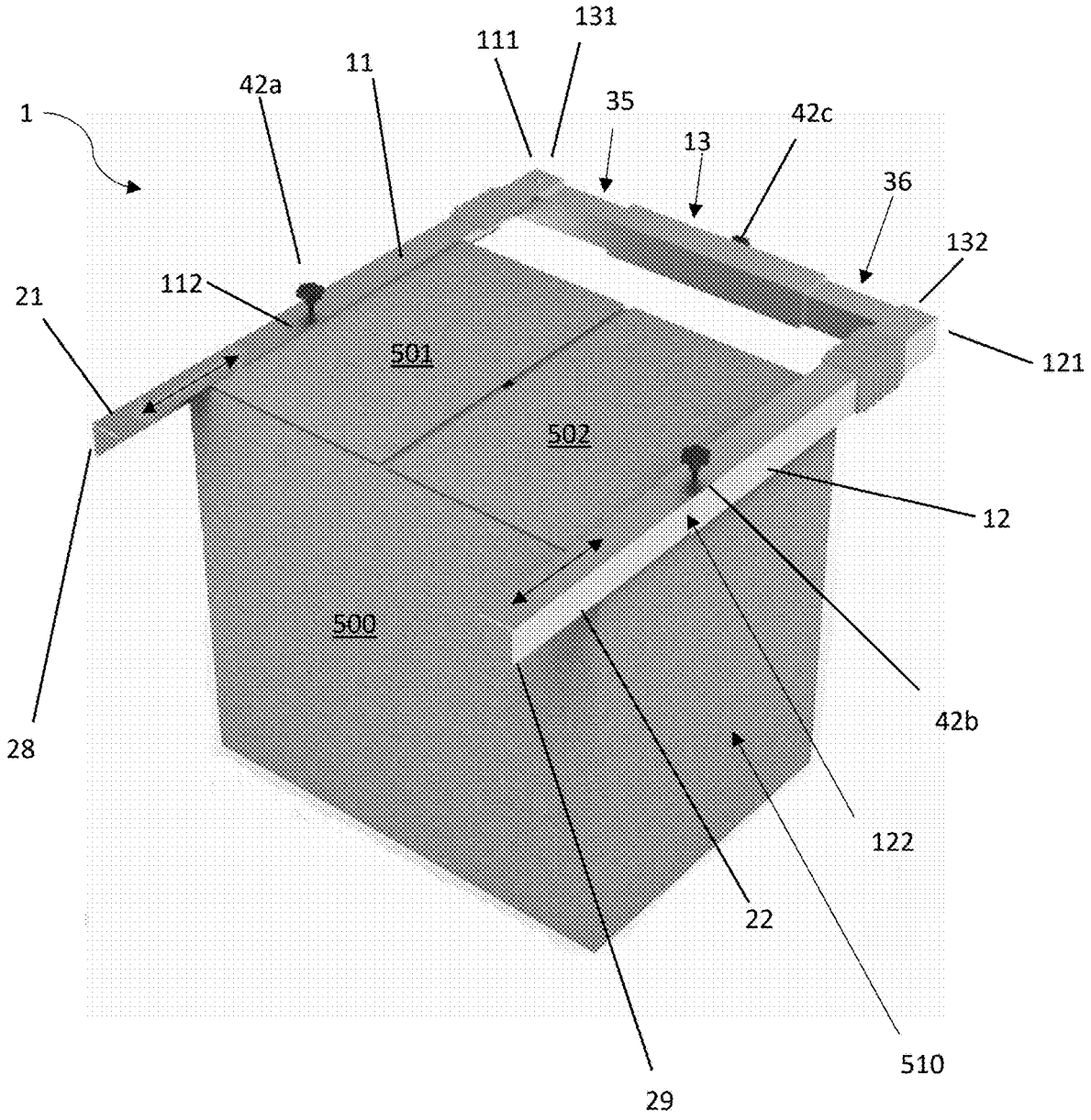
FIG. 1A is a perspective view of an exemplary embodiment of a box clamping apparatus of the present disclosure clamped to a box with the arms in a first position.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-6 of an adjustable clamping apparatus according to the present disclosure can have various components. In one exemplary embodiment, an apparatus 1 of the present disclosure can generally comprise an adjustable clamping member for aligning a shipping box's outer flaps 501, 502 together and clamping/holding the shipping box 500 in a closed position to facilitate a user to apply tape onto the shipping box 500. The apparatus 1 comprises adjustable clamping arm members configured to align along a perimeter of various sizes of shipping boxes'sidewalls and to position the box's outer flaps 501, 502 together in a closed position so that the user can easily and properly apply the adhesive tape onto the box. The box can have a first outer flap 501 and a second outer flap 502.

Figure 1B:
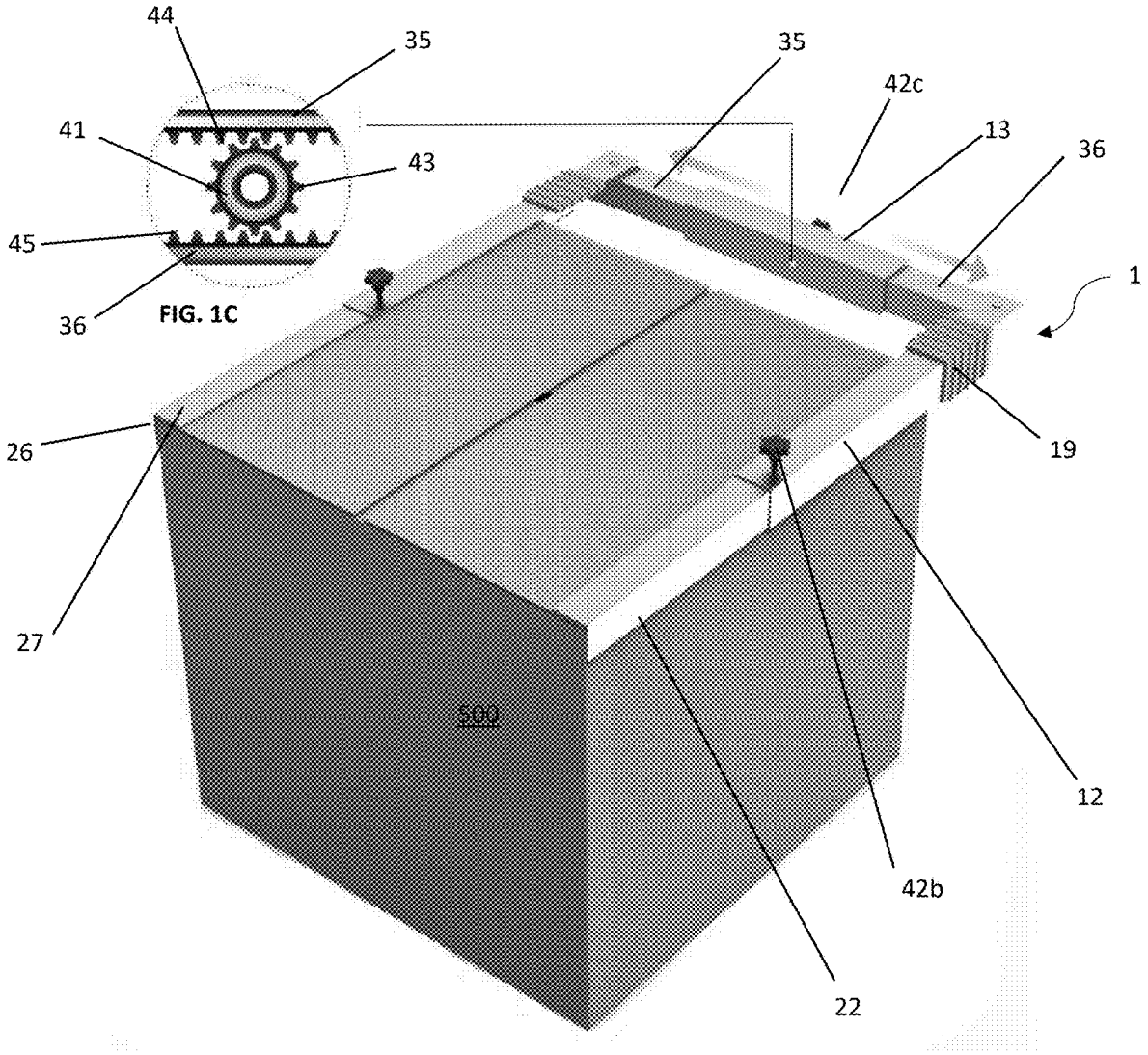
FIG. 1B is a perspective view of an exemplary embodiment of a box clamping apparatus of the present disclosure clamped to a box with the arms in a second position.
Figure 1D:
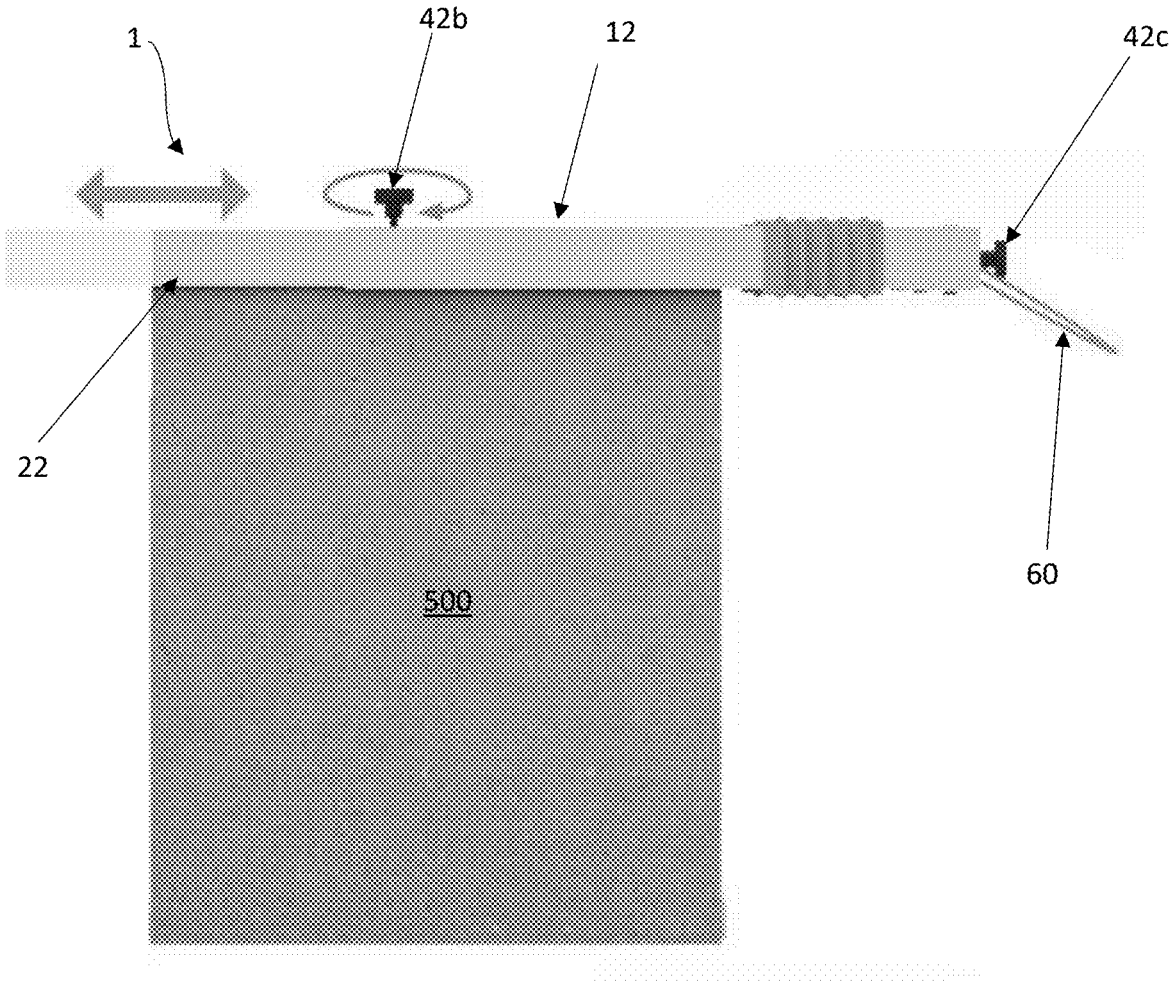
FIG. 1D is a side view of an exemplary embodiment of a box clamping apparatus of the present disclosure clamped to a box with the arms movable between a first position and a second position in length.
Figure 1E:
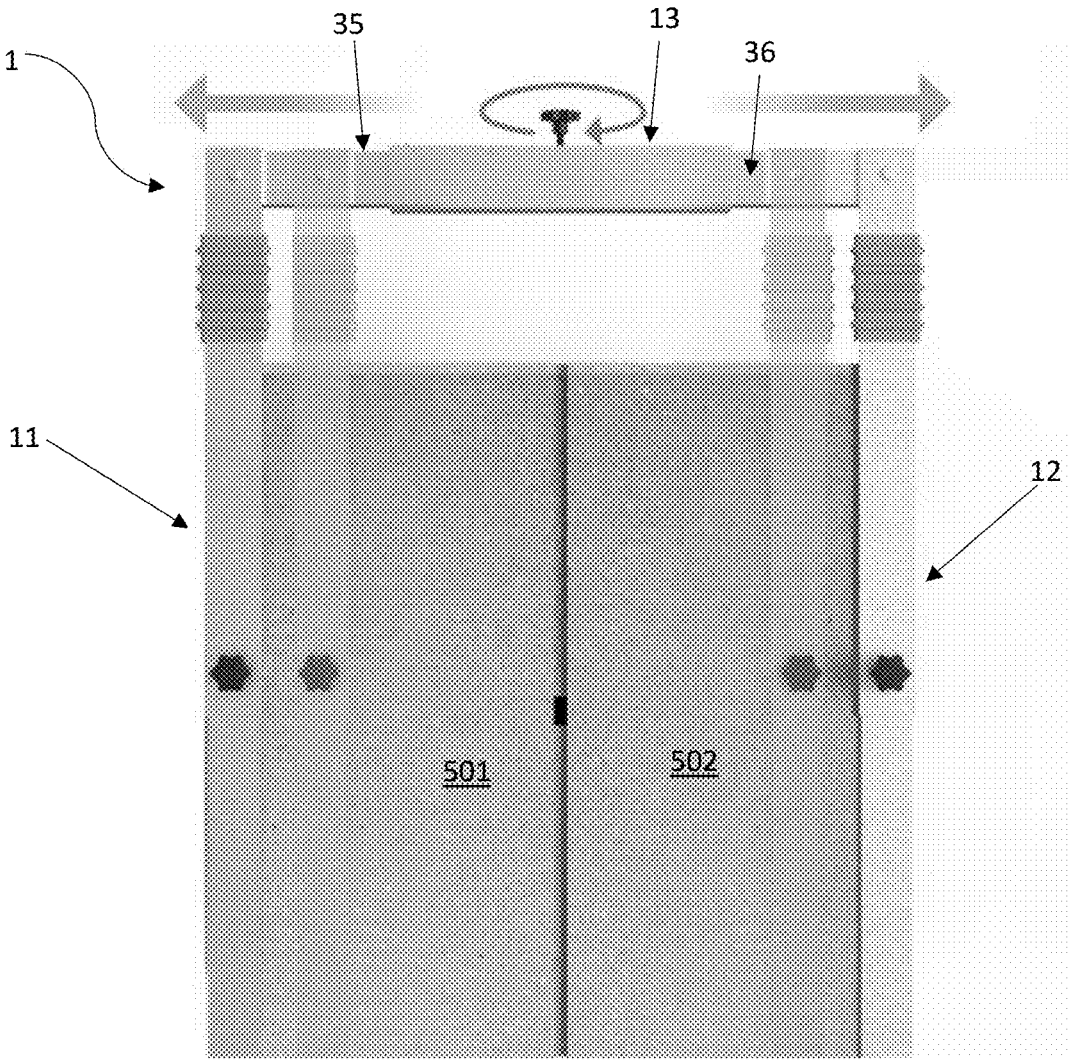
FIG. 1E is a top view of an exemplary embodiment of a box clamping apparatus of the present disclosure clamped to a box with the arms movable between a first position and a second position in width between the arms.
Figure 2A:
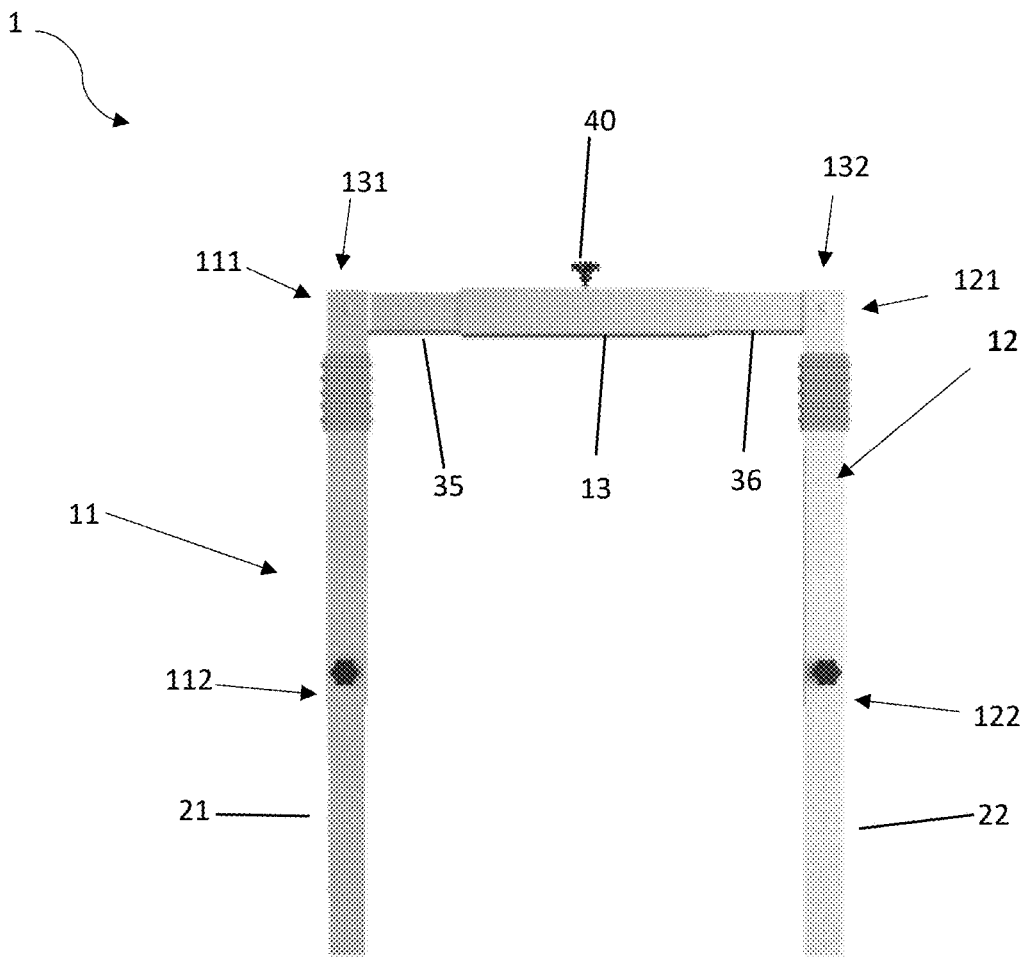
FIG. 2A is a top view illustration of an exemplary embodiment of the apparatus of the present disclosure.
Figure 2B:
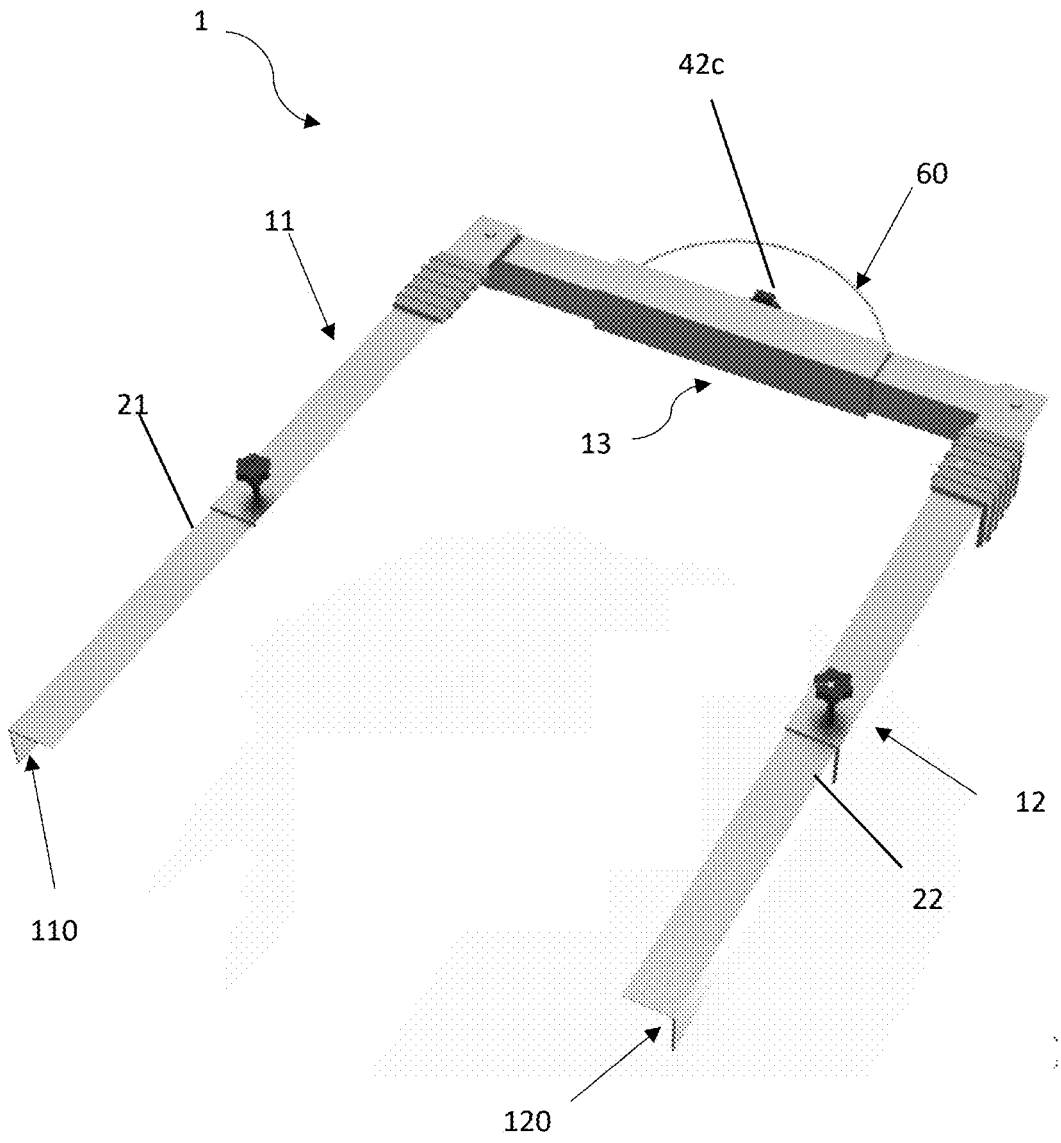
FIG. 2B is a perspective view illustration of an exemplary embodiment of the apparatus of the present disclosure.

As shown in FIGS. 1-2, some exemplary embodiments of the clamping apparatus 1 of the present disclosure can include a first clamping arm 11 and a second clamping 12, each having a first end 111, 121 and a second end 112, 122. The apparatus 1 can include a middle portion or member 13, having a first end 131 and a second end 132. The first end 131 of the middle portion 13 removably couplable to the first end 111 of the first arm 11 and the second end 132 of the middle portion 13 removably couplable to the first end 121 of the second arm 12. The distance between the first end 131 and the second end 132 can define a length of the middle portion 13, the distance between the first end 111 and the second end 112 defining a length of the first arm 11 and the distance between the first end 121 and the second end 122 defining a length of the second arm 12.

In some exemplary embodiments, an apparatus of the present disclosure can include a first extension arm 21 and a second extension arm 22. The first extension arm 21 can further extend between a first position and a second position from the first clamping arm 11. The first extension arm 21 and second extension arm 22 can extend past the ends 112 and 122 of the respective arms 11, 12 to provide additional length for larger boxes 500. The second extension arm 22 can extend between a first position and a second position from the second clamping arm 22 as shown in FIGS. 1A-D. The first extension arm 21 can be retractable and at least partially nested within the first clamping arm 11. Similarly, the second extension arm 22 can be retractable from the second clamping arm 12 and be at least partially nested or housed within the second clamping arm 22. The first and second extension arms can have first end and a second end. The second ends 28, 29 can define the end of the arms of the apparatus for the box and can allow the camping apparatus 1 arms to be extended to a desired length. Each of the clamping arms 11, 12 can include an adjustment mechanism 40 having a knob portion 42*a,b,c*. The adjustment mechanism can apply a friction force or locking force against the surface of the extension arms to maintain them at the desired position as shown in FIG. 1A.

Figure 3:
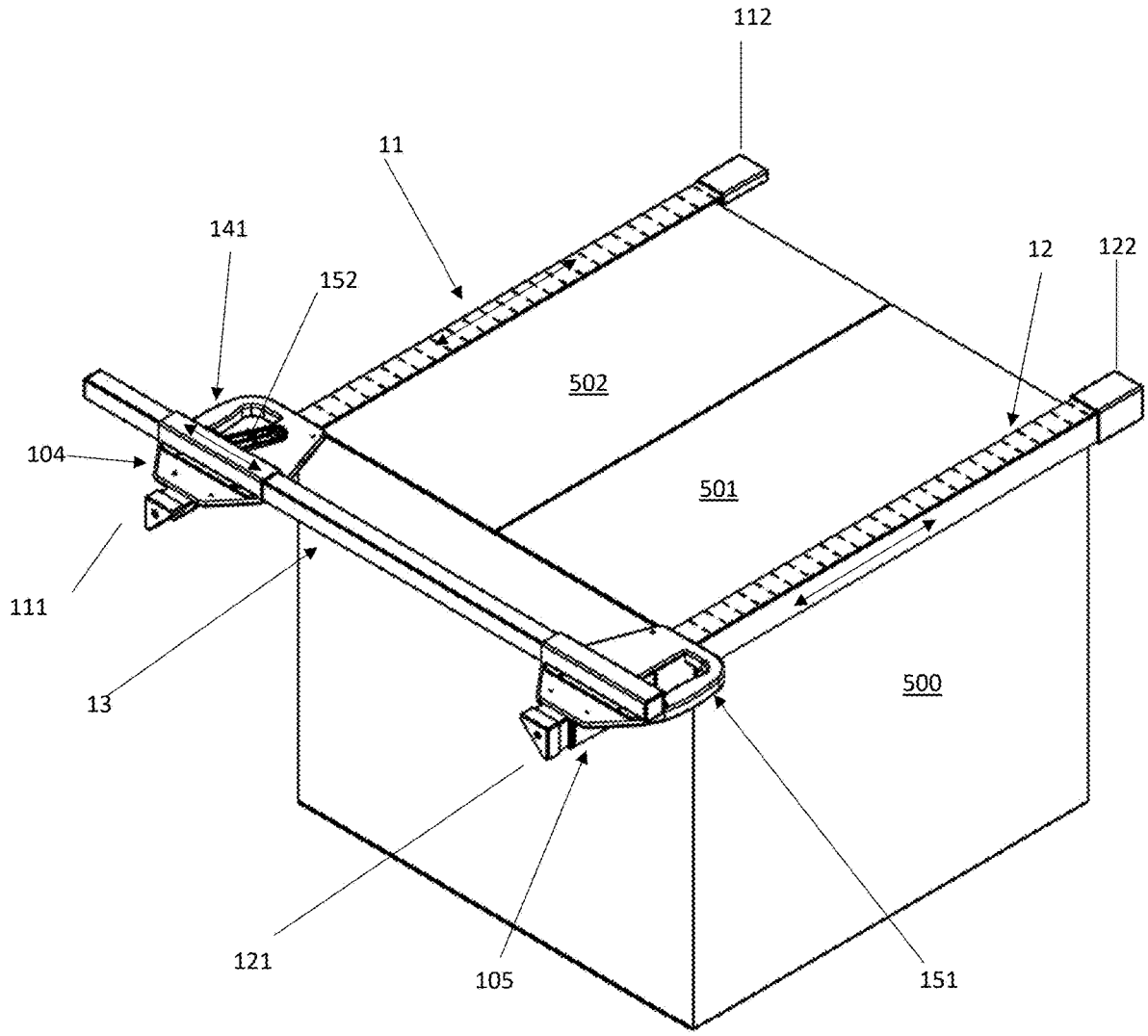
FIG. 3 is a perspective view of an exemplary embodiment of a box clamping apparatus of the present disclosure clamped to a box with the arms in a first position.

The first arm 11 and second arm 12 can be positioned generally parallel to each other and each generally perpendicular to the middle portion 13. The middle portion and the arms 11, 12 can be configured to move in gradual portions on an axis to extend the width of the middle portion 13 between the two arms 11, 12 as shown in FIG. 1B. The apparatus 1 may include extension arms 21, 22 and middle sliding assembly configured to move from an open position 200, wherein the user may be able to extend or adjust the length of the arms 11, 12 and/or the width of the middle portion 13, to a locking position. A user may be able lock the apparatus onto the box 500 when the desired length of the arms and/or middle portion is reached. The arms 11, 12 may comprise an interfacing portion 110, 120, configured to receive and securely hold an edge of the box. In some exemplary embodiments, the interfacing portion of the arms can have a generally L-shaped or form a right angle having a sidewall portion 26 and top portion 27 to form the interfacing. The right-angle configuration can provide an abutment surface or interfacing portion to one or more side of the box as the apparatus 1 is engaged with a box 500 as shown in FIG. 1B and FIG. 3. The middle sliding assembly can include a first interior arm 35 and a second interior arm 36 can be at least partially housed within the middle portion 13 as shown in FIG. 1B. A hanging member 60 can be removably coupled to the middle portion or end of the arms 11, 12 to allow a user to hang the apparatus 1 when not in use. The hanging member 60 can take any suitable configurations, including a cord or wire coupled at two different positions on the apparatus.

In some exemplary embodiments, a middle portion can comprise a first hollow member 13 and two members 35, 36 nested within the first hollow middle portion 13. The middle portion having an extendable length. The extendable mechanism generally manually actuated by the user by sliding the two members 35, 36 outwardly from within the hollow member 13. The extendable mechanism may be locked/unlocked via a ratchet mechanism actuated via a rotating knob 40, or any other suitable means. The clamping arms 11, 12 can also have at least one nested member 21, 22 for providing an extendable length. The clamping arms may further comprise a plurality of extendable nested members, for securing multiple boxes of the same size at the same time.

In some exemplary embodiments, an adjustment mechanism 40 can include a gear ring 41 that can be driven by a user by rotating the knob 42 around an axis as shown in FIG. 1C. The gear ring 41 can interface with one or more teeth or splines 44, 45 that can be formed on a surface of the one or more two members 35, 36. In some exemplary embodiments, the first arm 35 and second arm 36 of the middle portion can each have an interior side wall having corresponding splines 44, 45. At least one interior sidewall of the first arm 35 and at least one interior wall of the second arm 36 can include one or more splines 44, 45 to interface with the gear ring 41. As a user turns the knob 42, the gear ring splines 43 can interface with the splines 44, 45 of the first and second members 35, 36 to move the members 35, 36 from a first position to a second position as illustrated in FIG. 1B. This can be used to adjust the width of the middle portion and the distance between the first arm 11 and second arm 12. The apparatus can be made of lightweight and durable material, such as aluminum. It is also to be understood that the apparatus may be made of various dimensions, to fit different types of boxes. In some exemplary embodiments, the clamping arms 11, 12 can further include a grip portion 19 made of a soft material, such as rubber or silicone, to provide grip and comfortable support to the user.

A user may position the apparatus 1 over a shipping box 500 and twist the connector knob 42*c* to open or retract the clamping arms 11, 12, by sliding the two members 35, 36 outwardly or inwardly in relation to the middle member 13, until the clamping arms 11, 12 fit loosely around a portion of the perimeter of a box sidewalls 510 as shown in FIG. 1E. Once positioned, the user may twist the middle portion knob 42*c* to tighten the clamping arms 11, 12, holding the box in a closed position. In some embodiments, a similar mechanism may be used for extending or retracting the extension arms 21, 22 and then tightening the extension arms 21, 22 onto the box. The user can then securely apply adhesive tape onto the box. Alternatively, the clamping extension portions 21, 22 can be housed within a channel as part of the arms 11, 12 and can use a pressure locking knob 42*b* to tighten against the extension portions 21, 22 to lock them to the desired length by a user as shown in FIG. 1D.

In some exemplary embodiments as shown in FIGS. 3-6, the two arms 11, 12 and the middle portion 13 are movably coupled via a coupling member(s) 104, 105. Each of the arms can have a first end 111, 121 and a second end 112, 122. A first coupling member 104 can receive a first end 111 of arm 11 and a second coupling member 105 can receive the first end 121 of arm 12. The arms 11, 12 can have caps or grip portions 128 on each of the ends. The ends of the arms can be inserted and securely held within an interior channel 144 of the coupling member 104, 105. The channel 144 can allow for a user to adjust the length of the arms 11, 12 by pushing and pulling the arms through the channel 144 of the respective coupling member. The channel 144 can have a tight enough tolerance to the respective arm to allow for a friction fit capable of moving the arm by a user. The channel 144 can have an upper portion 145 and a sidewall portion 146 that can correspond to the shape of the arm 11, 12.

The channel 144 can have a shape approximate to the shape of the respective arm 11, 12 to partially house a portion of the respective arm 11, 12. In some exemplary embodiments, an additional compression member can be used to further maintain the position of the arms 11, 12 within the respective channels 144 of the coupling members 104, 105. The compression member can include a bolt or screw to maintain the arm in position. One or more of the coupling members 104, 105 can include a locking mechanism 150 that can include a lever portion 152 that can be moved by a user to engage or disengage the locking mechanism 150. The lever 152 can be removably coupled to the coupling member at a pivot point 153. The lever 152 can have a compressive force configured to maintain an engagement portion 154 against a portion of the middle portion 13 to prevent the coupling member from moving. In some exemplary embodiments, the compressive force can be maintained by a biasing member, including but not limited to a spring or other compressive member. As shown in FIG. 5B-C, an engagement portion 154 of the locking mechanism can engage a side of the middle portion 13 to maintain the coupling member in place until disengaged by a user by pulling or pushing the lever 152.

Figure 4A:
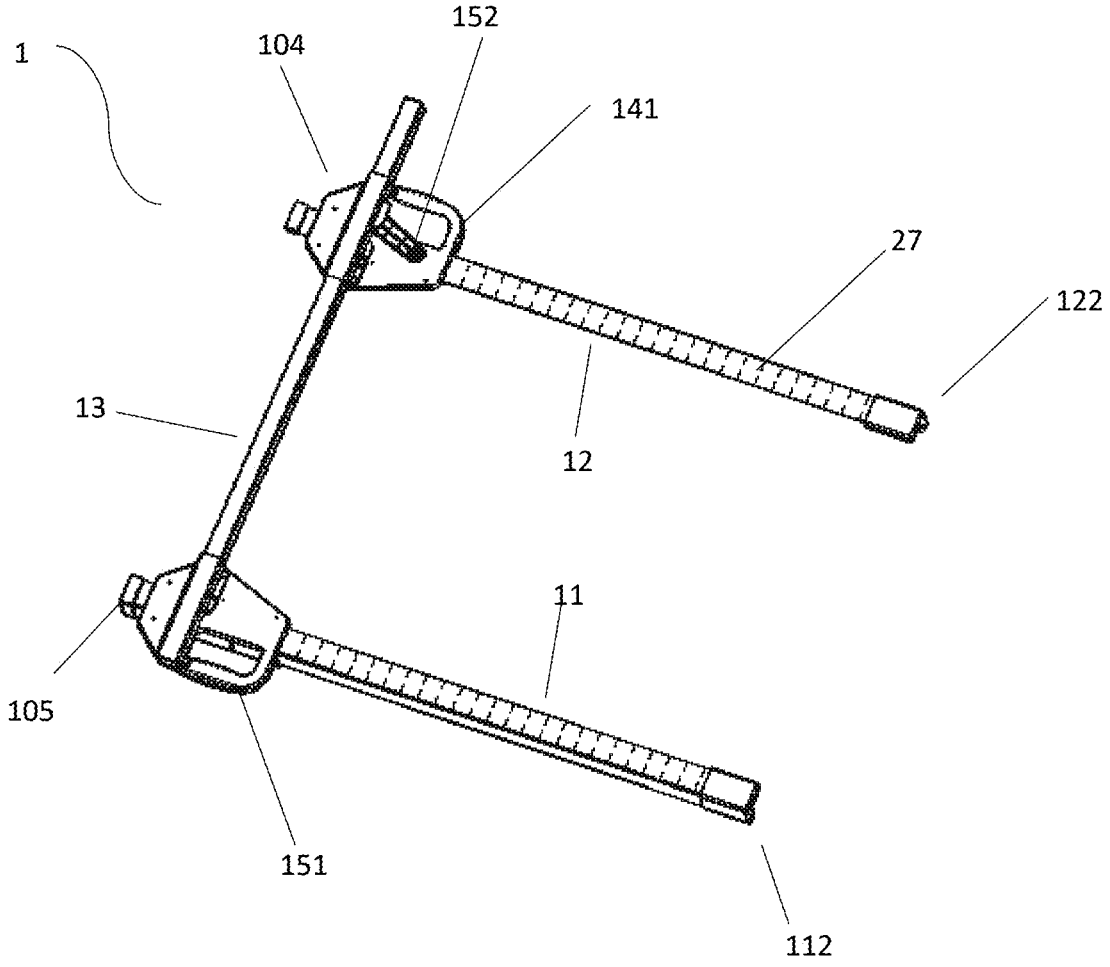
FIG. 4A is a top perspective view of an exemplary embodiment of the apparatus of the present disclosure.
Figure 4B:
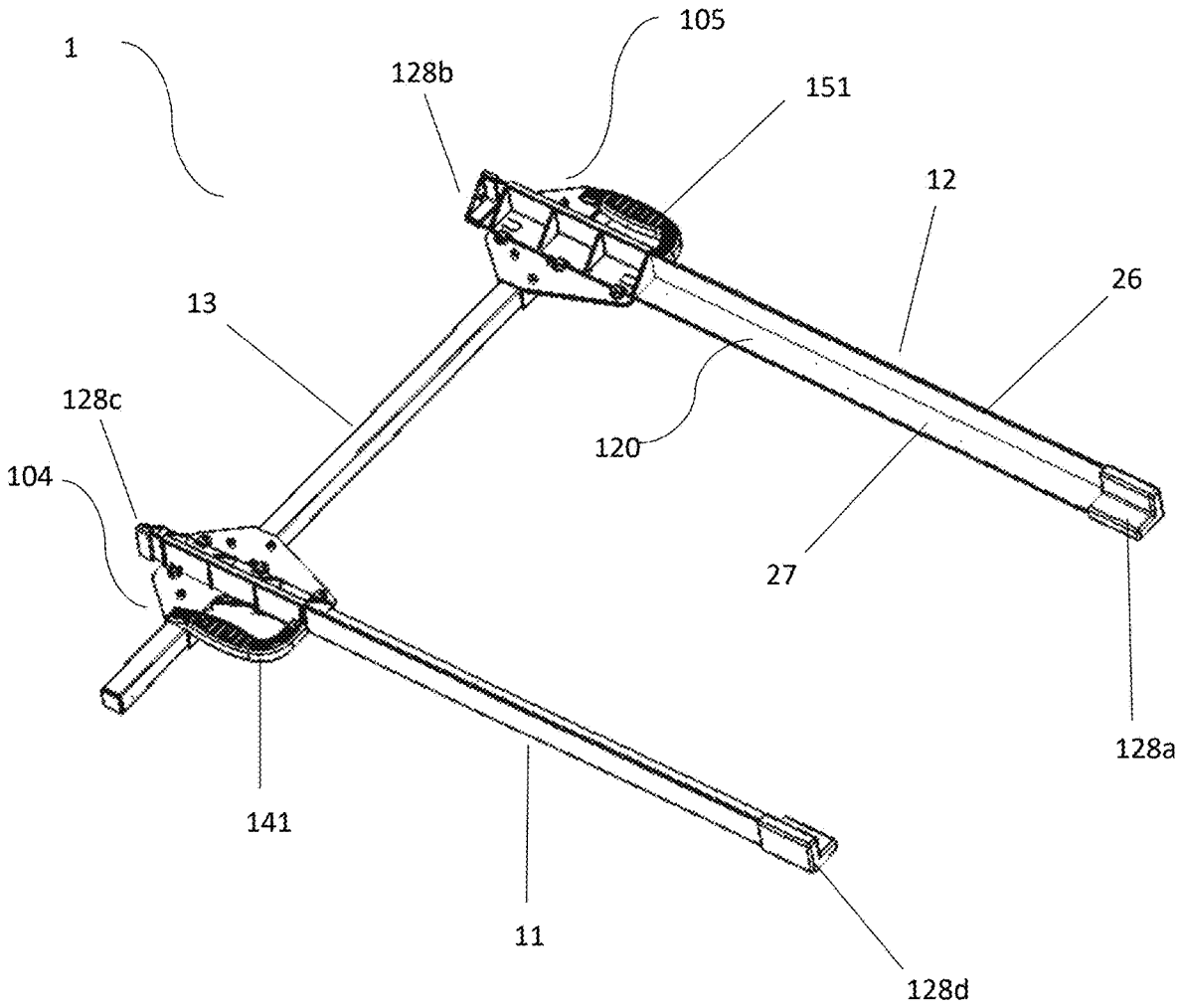
FIG. 4B is a bottom perspective view of an exemplary embodiment of the apparatus of the present disclosure.
Figure 4C:
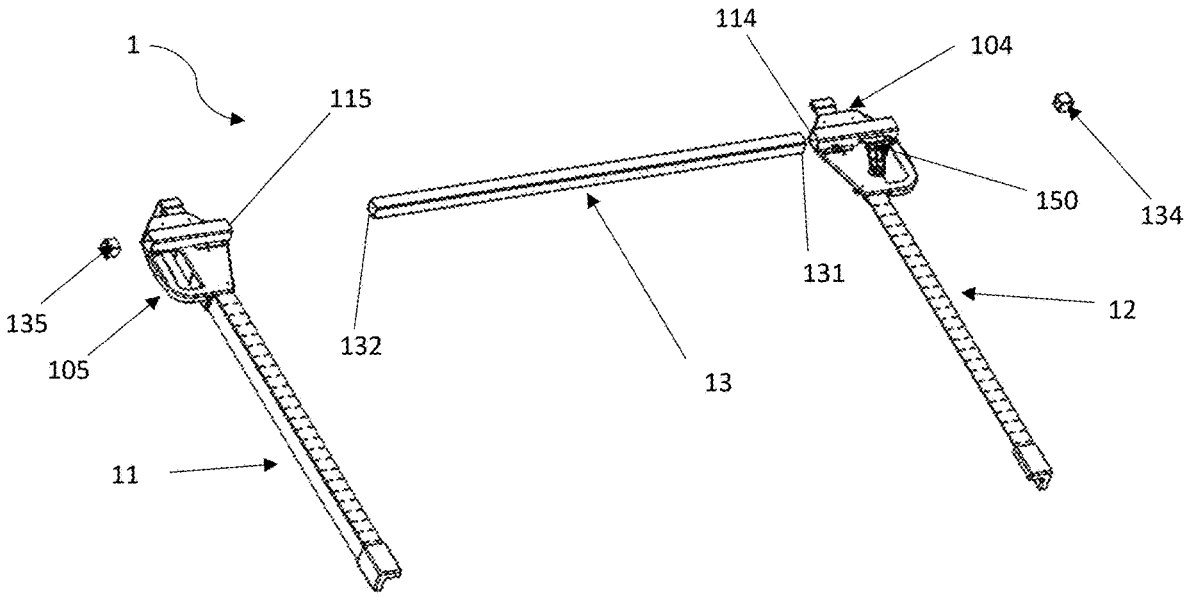
FIG. 4C is an exploded view of an exemplary embodiment of the apparatus of the present disclosure.
Figure 5A:
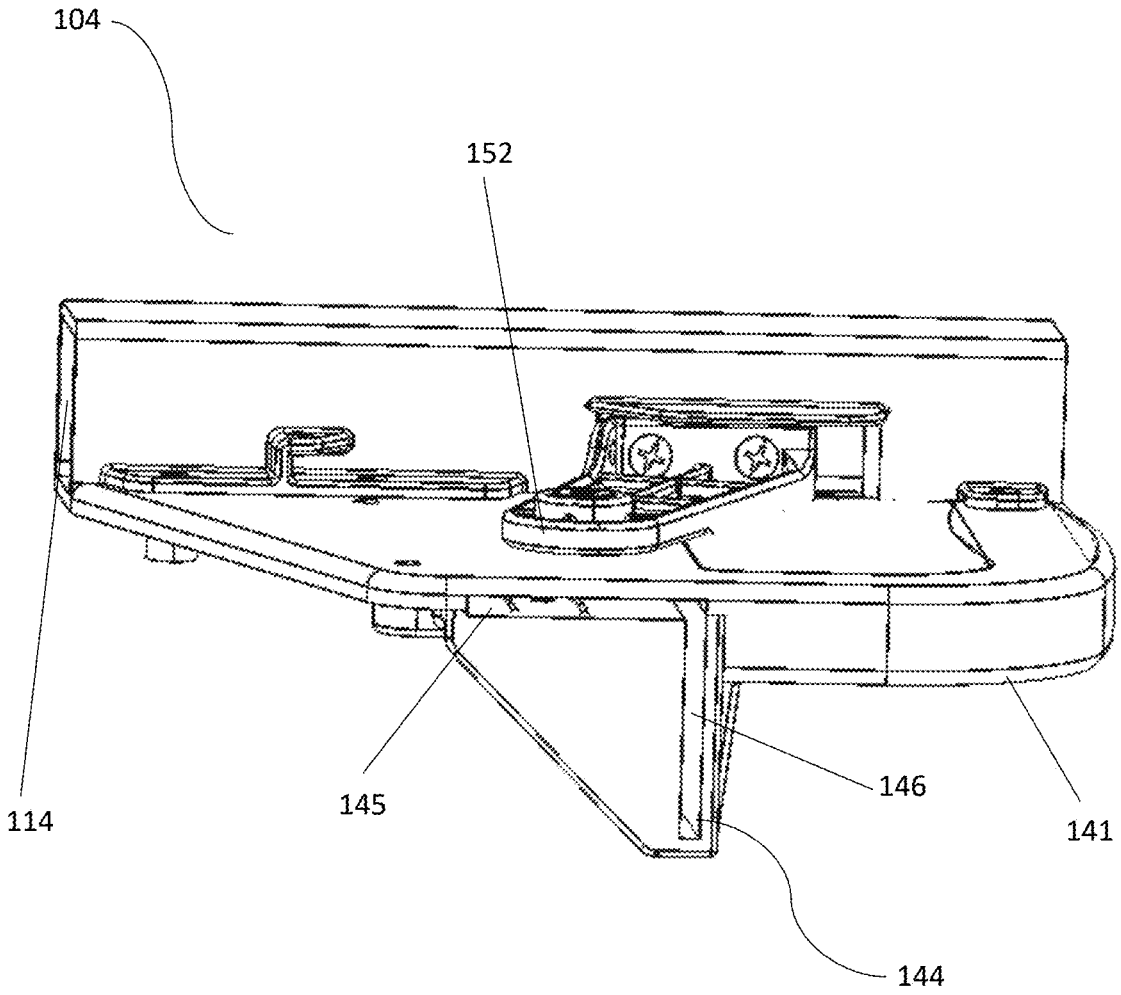
FIG. 5A is a perspective view and an exemplary embodiment of a coupling member of an apparatus of the present disclosure.
Figure 5B:
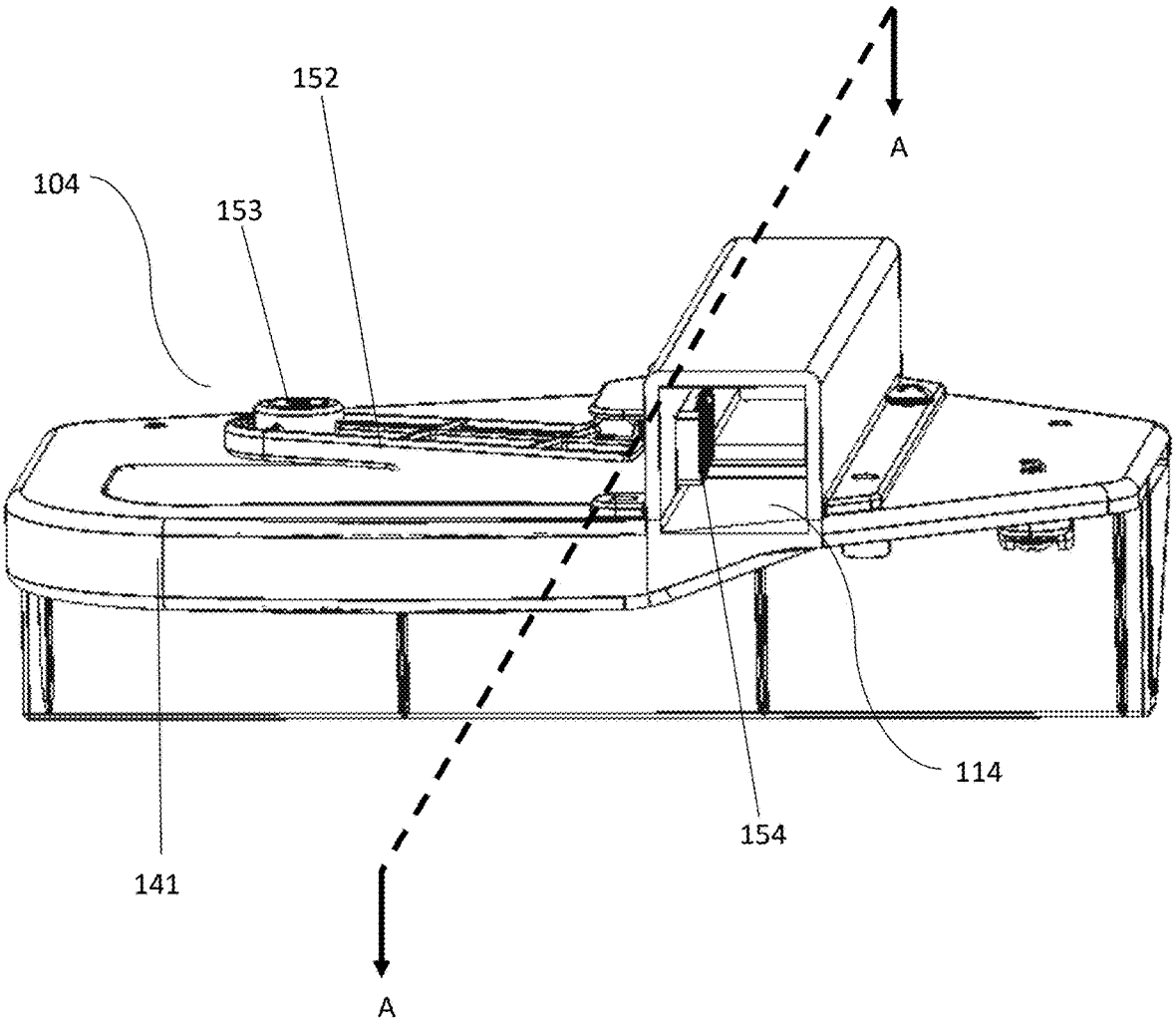
FIG. 5B is a side perspective view and an exemplary embodiment of a coupling member of an apparatus of the present disclosure.
Figure 5C:
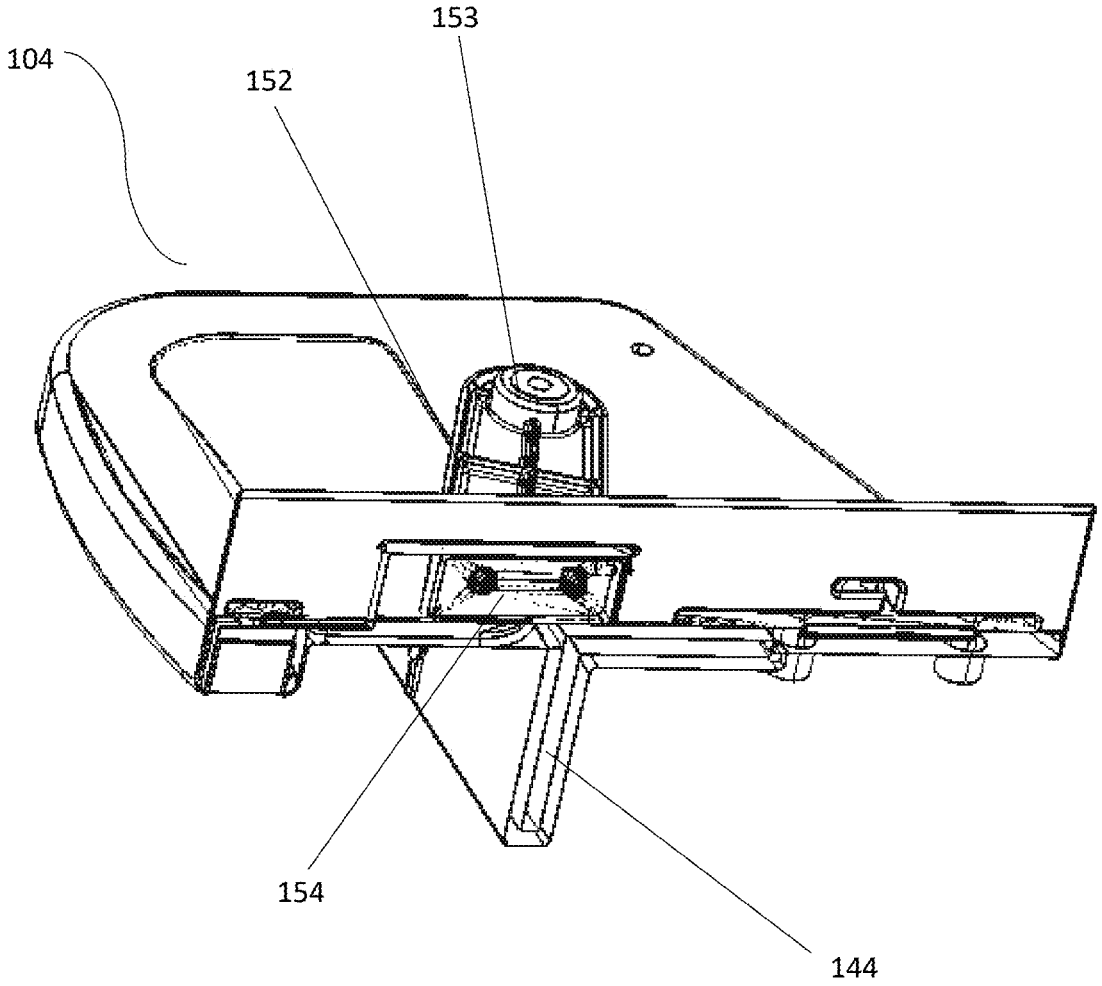
FIG. 5C is a cross-sectional view along axis A-A of FIG. 5B.

As shown in FIG. 4C and FIG. 5A, a coupling member 104, 105 can include a channel or opening 114, 115 that can house at least a portion of the middle portion 13. One or both of the coupling members 104, 105 can be movable along a length of the middle portion 13. In some exemplary embodiments, only a first coupling member 104 may include a locking mechanism 150 and be movable along the middle portion 13 while the other coupling member can be maintained at a fixed position on an opposite end of the middle portion 13. The second coupling member 105 can be fixed at a single location on the middle portion 13, while the first coupling member 104 can be movable along the middle portion 13 between a first and second position. The coupling member 104 can be moved along the axis of the middle portion 13 to allow a user to adjust to the width of a box 500 desired to be clamped. The locking mechanism 150 can apply a resistance pressure against the middle portion 13 to prevent movement of the coupling member 104 until desired by a user. A user can pull on the lever 152 to disengage the locking mechanism 150 to allow a user to move the coupling member along the middle portion 13 and adjust the width between the two arm members 11, 12.

The coupling members 104 and 105 can also have an additional channel 114, 115, located on another plane over the arms 11, 12. The coupling member 104 can receive and secure a first end 131 of the middle portion 13 and the coupling means 105 receives and holds the second end 132 of the middle portion 13. The user is able to adjust the length of the middle portion 13 by pulling and pushing the coupling members or the arms or the middle portion itself. The coupling members 104, 105 may have handles 141, 151 to facilitate the user when adjusting the lengths of the parts. The coupling member 104, 105 may have a locking mechanism 150, to secure the apparatus onto the box when the desired length is reached. One or more end caps 134, 135 can be positioned and removably coupled to the first end 131 and second end 132 of the middle portion 13. The end caps

134, 135 can prevent the coupling members 104, 105 from being able to slide off the middle portion during movement along the middle portion 13.

The user may position arm 11 onto a side of a box, and then adjust the length of the middle portion 13 by pulling or pushing handle 151. When the desired length is reached and arm 12 is placed onto the opposite side of the box, the user may lock the coupling members 104, 105. A locking mechanism 150 can allow a user to lock the apparatus 1 to the desired width to maintain the apparatus on the box 500. Alternatively, the user may extend the coupling members 104, 105 to a length bigger than the dimensions of the box, them push both arms 11, 12 onto the opposite sides of the box by pushing the coupling members 104, 105 via the handles 141, 151.

Figure 6A:
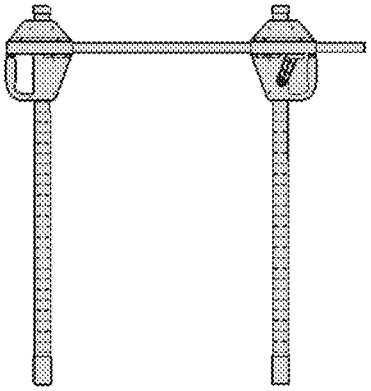
FIG. 6A is an illustration of an exemplary embodiment of an apparatus of the present disclosure.
Figure 6B:
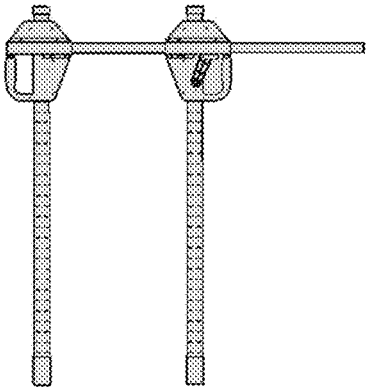
FIG. 6B is an illustration of an exemplary embodiment of an apparatus of the present disclosure wherein a coupling member has been moved along the middle portion to adjust the width.
Figure 6C:
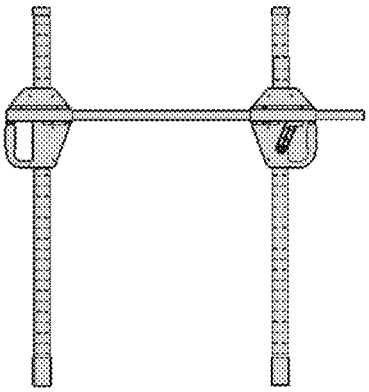
FIG. 6C is an illustration of an exemplary embodiment of an apparatus of the present disclosure wherein the arms have been moved along within the corresponding coupling members to adjust the length of the arms.

As shown in FIGS. 6A-6C, various portions of the apparatus can be slidably coupled to each other. At least one of the coupling members 104, 105 can be slidably couplable to the middle portion or member 13 to allow for the coupling member 104 to move along the middle portion 13 to allow for the width between the two arms 11, 12 to be adjusted as shown in FIGS. 6A-B. Similarly, the arms 11, 12 can be slidably coupled within the respective coupling members 104, 105 to allow the arms to extend or retract depending upon the size of the box the apparatus 1 is applied to. This can allow for the apparatus to accommodate various sizes of boxes and clamp to the box as desired.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An adjustable clamping apparatus, comprising:

a first arm member having a first end and a second end;

a first extension arm slidably coupled to the first arm member;

a second arm member having a first end and a second end;

a second extension arm slidably coupled to the second arm member;

a middle member having a first end, second end, an interior cavity, a first interior arm, and a second interior arm, wherein the first interior arm has a first and second end and second interior arm having a first and second end, wherein each interior arm is at least partially housed within the interior cavity of the middle member, wherein the first arm member is coupled to the second end of the first interior arm and the second arm member is coupled to the second end of the second interior arm of the middle member, wherein the middle member further includes an adjustment mechanism configured to move the first interior arm and second interior arm between a first position and a second position.

2. The adjustable clamping apparatus of claim 1, wherein the adjustment mechanism includes a gear ring having a plurality of splines, wherein an interior of the first interior arm includes a plurality of splines and an interior of the second interior arm includes a plurality of splines, wherein the splines of the gear ring interface with the splines of each of the first interior arm and second interior arm.

* * * * *